US007644459B1

(12) United States Patent
Olson

(10) Patent No.: US 7,644,459 B1
(45) Date of Patent: Jan. 12, 2010

(54) THERAPEUTIC CUSHIONS AND PILLOWS AND METHODS OF THEIR MANUFACTURE AND USE

(75) Inventor: Daniel Jonathan Olson, Santa Monica, CA (US)

(73) Assignee: Daniel J Olson, Santa Monica, CA (US)

( * ) Notice: Subject to any disclaimer, the term of this patent is extended or adjusted under 35 U.S.C. 154(b) by 0 days.

(21) Appl. No.: 12/012,662

(22) Filed: Feb. 4, 2008

Related U.S. Application Data

(63) Continuation of application No. 11/521,937, filed on Sep. 15, 2006, now Pat. No. 7,325,266.

(60) Provisional application No. 60/718,191, filed on Sep. 16, 2005.

(51) Int. Cl.
*A47C 16/00* (2006.01)
*A47C 20/00* (2006.01)

(52) U.S. Cl. ..... 5/645; 5/646; 5/648; 5/630

(58) Field of Classification Search ..... 5/630, 5/632, 636, 640, 645, 722, 646, 648, 621–624, 5/490

See application file for complete search history.

(56) References Cited

U.S. PATENT DOCUMENTS

| | | | |
|---|---|---|---|
| 247,892 | A | 10/1881 | Doremus |
| 380,713 | A | 4/1888 | Clement |
| 395,043 | A | 12/1888 | Doremus |
| 681,573 | A | 8/1901 | Nichols |
| 754,329 | A | 3/1904 | Milliken |
| 1,385,355 | A | 7/1921 | Banks |
| 1,447,288 | A | 3/1923 | Emmerich |
| 2,013,481 | A | 9/1935 | Stonehill |
| 3,459,179 | A | 8/1969 | Olesen |
| 3,849,810 | A | 11/1974 | Degen |
| 3,879,775 | A | 4/1975 | Iwata |
| 4,275,473 | A | 6/1981 | Poirier |
| 4,393,520 | A | 7/1983 | Koch |
| 4,606,087 | A | 8/1986 | Alivizatos |
| 4,689,844 | A | 9/1987 | Alivizatos |
| 4,843,666 | A | 7/1989 | Elesh et al. |
| 4,853,994 | A | 8/1989 | Ekstein |

(Continued)

FOREIGN PATENT DOCUMENTS

| | | |
|---|---|---|
| WO | WO 92/10966 | 7/1992 |

*Primary Examiner*—Robert G Santos
(74) *Attorney, Agent, or Firm*—Daniel J. Olson

(57) ABSTRACT

A cushion or pillow device may comprise first and second tubular members joined at respective lateral portions to define valleys between the tubular members. The tubular members may comprise an outer covering and an inner portion comprising a pliable filler. The outer covering may be fabric that is joined to define the tubular members. The outer covering may be closed to contain the pliable filler. The outer cover may also have open ends for receiving inserts containing pliable filler that are placed within the outer covering. The cushion or pillow device may be manufactured in a number of manners, such as by joining of a fabric or another material to define sleeves, or by molding. The cushion or pillow device may be inserted in a case having an elongate portion for tucking between the frame and mattress of a gurney, hospital bed or the like. The elongate portion may be provided with a cutaway or slit defining separate arms, or a perforation that allows tearing to form the arms.

20 Claims, 6 Drawing Sheets

U.S. PATENT DOCUMENTS

| | | | |
|---|---|---|---|
| 4,884,305 | A | 12/1989 | Blackmon |
| 4,928,337 | A | 5/1990 | Chauncey |
| D354,356 | S | 1/1995 | Shiflett |
| 5,388,295 | A | 2/1995 | Sarkozi |
| 5,418,991 | A | 5/1995 | Shiflett |
| 5,421,044 | A | 6/1995 | Steensen |
| 5,572,757 | A | 11/1996 | O'Sullivan |
| 5,618,263 | A | 4/1997 | Alivizatos |
| 5,653,195 | A | 8/1997 | Young |
| 5,682,632 | A | 11/1997 | Cotroneo |
| 5,765,245 | A | 6/1998 | Breto |
| 5,987,676 | A | 11/1999 | Littleford et al. |
| 6,058,535 | A | 5/2000 | Firkins et al. |
| 6,170,103 | B1 | 1/2001 | Wang et al. |
| 6,438,805 | B1 | 8/2002 | Goss et al. |
| 6,442,778 | B1 | 9/2002 | Shaharbani |
| 6,446,288 | B1 | 9/2002 | Pi |
| 6,539,565 | B1 | 4/2003 | Trimble |
| 6,578,218 | B2 | 6/2003 | Wassilefsky |
| 6,601,252 | B1 | 8/2003 | Leach |
| 6,751,818 | B2 | 6/2004 | Troop |
| 6,782,572 | B1 | 8/2004 | Jones |
| 6,839,929 | B2 | 1/2005 | Stolpmann |
| 6,951,035 | B2 | 10/2005 | Kinchen et al. |
| 7,325,266 | B1 * | 2/2008 | Olson ..... 5/630 |
| 2002/0088057 | A1 | 7/2002 | Wassilefsky |

* cited by examiner

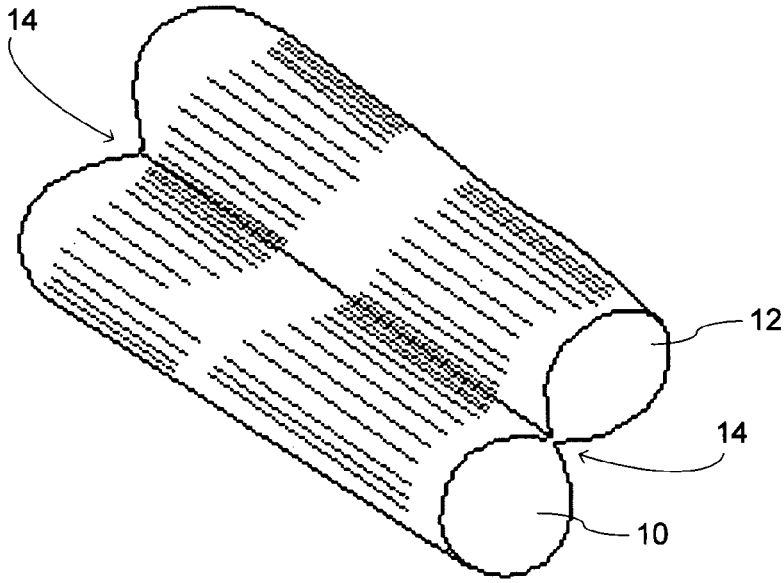
Figure 1
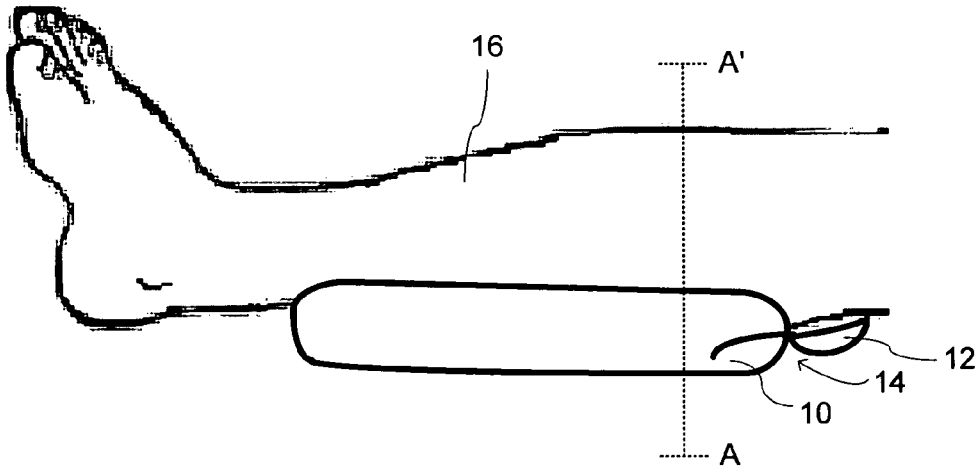
Figure 2
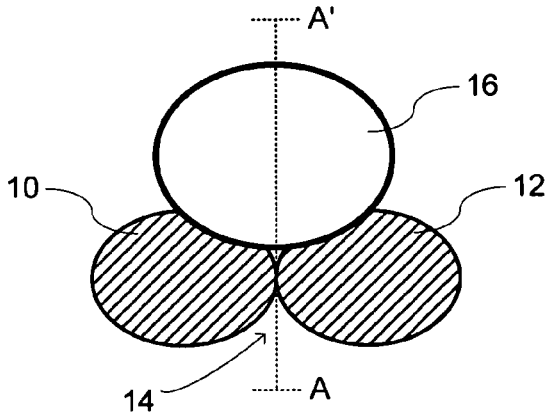

THERAPEUTIC CUSHIONS AND PILLOWS AND METHODS OF THEIR MANUFACTURE AND USE

RELATED APPLICATIONS

This application is a continuation of co-pending U.S. patent application Ser. No. 11/521,937, filed Sep. 15, 2006, to be issued as U.S. Pat. No. 7,325,266, which claims priority from U.S. provisional application 60/718,191 filed Sep. 16, 2005, which is incorporated by reference for its teachings of the structures, manufacture and uses of then-preferred embodiments and alternative embodiments.

BACKGROUND

1. Field

Embodiments of the present invention relate generally to comfort or support devices, and more particularly to medical support cushions and pillows.

2. Related Technology

Devices such as cushions or pillows are used in a variety of manners to position, support or provide comfort to a medical patient.

U.S. Pat. No. 6,751,818 discloses an airway management apparatus and method that are capable of easing the breathing and aiding the alignment of the oral, pharyngeal, and laryngeal axes of the airway of obese individuals in the supine position. The apparatus includes an upper-body support, and a head and neck support having a partially concave and partially convex surface coupled to the upper-body support.

U.S. Pat. No. 5,682,632 discloses a jaw thrust support suitable for engaging the angles of the mandible of a patient to provide an airway for the patient. This device is constructed of polymeric materials suitable for conforming to the angles of the patient's jaw while continuing to provide suitable support to the jaw by distracting the jaw forward away from the patient's head and neck.

U.S. Pat. No. 6,539,565 discloses a partial sheet construction that engages a mattress securely and provides a concealed compartment for a pillow. The sheet construction includes a main panel having a pouch to encompass a first end of the mattress and flaps to encompass a mid-portion of the mattress. An auxiliary panel cooperates with the main panel to form a pillow-receiving concealment pocket. The pouch and flaps secure the sheet construction to the mattress, and the concealment pocket maintains a pillow in a desired location during use.

U.S. Pat. No. 4,884,305 discloses a device for maintaining bedding in position on a mattress. The device is a partial coverlet that fits over a portion of the end of the mattress and is held in place by elastic straps which grips the sides of the mattress to hold the mattress pad and sheet.

U.S. Pat. No. 6,446,288 discloses a medical support pillow for endotracheal intubation comprising a base member having a pair of oppositely positioned sidewalls, a bottom portion having a bottom surface, and an upper portion. The upper portion includes a generally concave-shaped recess for receiving the occipital area of a patient's head. In other embodiments, the medical support pillow includes a pad portion, a cavity, and a hemispherical member removably disposed within the cavity. The hemispherical member may be removed to allow the rear of the patient's head to sink into the cavity to substantially eliminate pressure on the occipital area and to prevent any substantial movement of the patient's head.

PCT App. No. WO92/10966 discloses a head support, such as a pillow, particularly for use in nursing. The head support comprises a filling enclose in a gas or fluid tight cover of impermeable material with through ventilation holes interconnecting the two major faces of the pillow. The cover can be cleaned and thoroughly sterilized by spraying or wiping with an antiseptic fluid and protects the filling from contamination when in use.

U.S. Pat. No. 6,438,805 discloses a pillow-securing device for releasably holding a pillow position on an elevated surface. The pillow-securing device comprises a plurality of straps with one end of each strap attached or secured to a connector ring and a clasp to the other end of the straps. In use at least one of the straps is secured by means of the clasp to the pillow and at least one of the straps is secured by means of the clasp to the elevated surface.

U.S. Pat. No. 6,782,572 discloses a multi-use pillow that includes a closed-end fabric body member of generally hollow cylindrical geometry and having at least two narrow attachment strips, each comprising a loop fastener material on one surface of the strip and having a smooth surface on the opposite surface of the strip. Flexible elongated mounting straps are also included with their ends anchored to the two attachment strips that encircle the girth of the cylindrical fabric body.

During an emergency medical situation, the Emergency Medical Services (EMS) personnel typically use a gurney for transporting a patient. The patient's comfort can be greatly increased by using a pillow along with the gurney. But pillows are hard to keep up under the patient's head due to lack of surface area between the rear of the head and the top of the gurney. Keeping the head clamped over the pillow causes great discomfort for the patient. Also, pushing the pillow back under the patient's neck distracts the EMS personnel, and therefore, in many cases pillows are discarded. Moreover, most of the pillows are bulky and take up a lot of space in an ambulance, thus making their transport difficult.

SUMMARY

Cushion or pillow devices, methods of their manufacture, and therapeutic methods of their use for comfort, support and positioning are disclosed.

A cushion or pillow device may comprise first and second tubular members joined at respective lateral portions to define valleys between the tubular members. The tubular members may comprise an outer covering and an inner portion comprising a pliable filler. The outer covering may be fabric that is joined to define the tubular members. The outer covering may be closed to contain the pliable filler. The outer cover may also have open ends for receiving inserts containing pliable filler that are placed within the outer covering.

The cushion or pillow device may be manufactured in a number of manners, such as by joining of a fabric or another material to define sleeves, or by molding.

The cushion or pillow device may be inserted in a case having an elongate portion for tucking between the frame and mattress of a gurney, hospital bed or the like. The elongate portion may be provided with a cutaway or slit defining separate arms, or a perforation that allows tearing to form the arms.

Other features of cushions or pillow devices, their manufacture, and their uses are provided in the description and drawings that follow.

DESCRIPTION OF THE FIGURES

FIG. 1 shows an embodiment of a cushion or pillow device.

FIG. 2 shows the use of a cushion or pillow device to support a limb.

FIGS. 10, 11, 12 and 13 show an embodiment using a cushion or pillow device with a gurney, hospital bed or the like.

FIGS. 14 and 15 show embodiments of cases for a cushion or pillow device for use with a gurney, hospital bed or the like.

DETAILED DESCRIPTION

Figure 3:
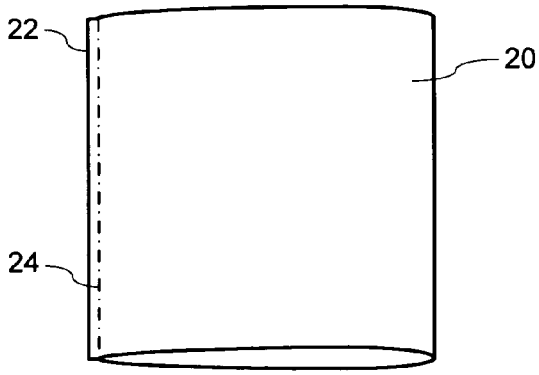
FIGS. 3, 4, 5, 6, 7, 8 and 9 show structures formed during the manufacturing of a cushion or pillow device in accordance with a preferred manufacturing method.

FIG. 1 illustrates a preferred embodiment. The embodiment is a pillow- or cushion-like device composed of two generally tubular members 10, 12 of approximately equal length and girth that are joined at their edges so as to define valley portions 14. The outer covering of the pillow or cushion device is preferably a sturdy, comfortable material having good durability and washability, such as a cotton or synthetic fleece fabric, and is preferably antibacterial. The tubular members 10, 12 may contain a pliable fill material. Examples of fill materials that may be used in various embodiments include polyfill or other natural or synthetic fibers, foam rubber, down, air, water, and heat or cold-retaining gels. The length and girth of the tubular members 10, 12 and the resulting size and shape of the valley portions 14 may be selected in accordance with the desired use of the structure.

Pillow or cushion devices such as those shown in FIG. 1 have a variety of applications for providing positioning, support or comfort, particularly to a medical patient. FIG. 2 shows an example of the use of the pillow or cushion device for positioning or supporting a limb 16 such as a patient's lower leg. In this case, the limb 16 is rested on the pillow in a valley 14 between the two tubular members 10, 12. For such applications, the tubular members 10, 12 may have lengths of approximately 16 inches and cross-sectional widths of approximately 3½ inches at their broadest points. Other dimensions may also be used.

The use of the pillow or cushion device for limb support in this manner may have a number of beneficial effects compared to, for example, the use of a standard monolithic bed pillow for the same purpose. First, the tubular members 10, 12 have the effect of cradling the limb 16 at opposing sides, as shown in the sectional view of FIG. 2 taken along line A-A', such that the weight of the limb 16 tends to retain the limb 16 in a relatively stationary position within the valley 14. A person using such a pillow or cushion device to elevate a leg or other limb may find that the limb tends not to slip off of the pillow or cushion. This may be particularly advantageous when, for example, the patient is in a moving vehicle such as an ambulance where sudden movements may be encountered and it is desired immobilize the limb.

Further, since the relative positions of the tubular members 10, 12 and the valleys 14 are substantially fixed, they will retain their basic shape and configuration with less need to be shaped or reshaped before or during use. In addition, as seen in the sectional view, the pillow or cushion device may distribute the weight of the limb 16 more evenly about the surface of the limb 16, since the valley 14 and the pliable fill material allow the pillow to substantially conform to the shape of the limb 16 in response to the weight of the limb 16 and thus to substantially reduce pressure points on the skin. This enhances the comfort of the pillow, and may be of particular benefit to persons who are at risk of pressure sores from being in a sitting, lying or other stationary position for a significant period of time.

A pillow or cushion device as shown in FIG. 1 may also be used to position or support a person's head. As one example, a person in a sitting position, such as in an airplane seat, may position the pillow or cushion with respect to his or her head such that the curvature of the head is supported within a valley 14 between the tubular members 10, 12. In such use the ability of the tubular members 10, 12 and valley 14 to conform to the curvature of the user's head may allow the pillow or cushion to remain in a desired position without slipping. The ability of the tubular members 10, 12 and the valley 14 to cradle the head may also help to retain the user's head and neck in a comfortable position and to resist the tendency of the user's head and neck to bend or roll to one side, for example, when the user is asleep in a sitting position such as on an airplane. Moreover, when positioned at the side of the user's head, a valley 14 of the pillow or cushion may be located over the user s ear so as to avoid placing substantial pressure on the ear, thus providing enhanced comfort.

In another application, a pillow or cushion device as shown in FIG. 1 may also be used for support of a body part at a pressure point, such as at a heel, knee, wrist or elbow. The pillow or cushion device may also be used for protection or comfort enhancement in conjunction with a piece of furniture or equipment, for example, as a bedrail pad or as a pad for an armrest.

While the aforementioned uses deploy the pillow or cushion device in a generally flat orientation with the tubular members side-by-side, the flexible and pliable nature of the cushion or pillow device allows it to be folded over upon itself along one of the valleys to provide a narrow, fairly dense support structure. For example, the pillow or cushion device may be folded over upon itself and positioned beneath the lower back of a patient in a lying position to provide lumbar support. The pillow or cushion device may similarly be placed beneath the neck or knee to achieve a similar effect. When used in this manner, the pillow or cushion device may provide a more focused support point than would be achieved using a standard bed pillow.

The pillow or cushion device may be manufactured with various lengths and thicknesses of the tubular members in order to customize the device for various uses as described above. For many of those uses, the pillow or cushion device will be smaller than the standard bed pillow that would typically be employed for similar purposes. This provides the benefit of efficient storage, particularly in environments such as ambulances where storage is significantly limited.

The structure of the tubular members 10, 12 and the manner in which they are joined along their lateral edges may be implemented in a variety of manners. In a preferred manufacturing method the tubular members 10, 12 are formed from a single sheet of fabric that is selectively joined to itself by stitches or another joining structure to form two closed sleeves containing a fill material. Structures formed during the course of the preferred manufacturing method are illustrated in FIGS. 3-10.

Figure 4:
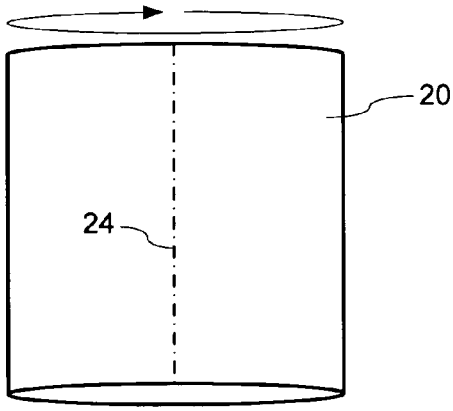

Initially, as shown in FIG. 3, a workpiece 20 comprised of a single sheet of fabric such as cotton or synthetic fleece is laid flat and folded in half to bring two opposing edges 22 substantially into alignment. As shown in FIG. 3, a stitch or other joining structure 24 is formed to join the aligned edges of the workpiece 20 to form a sleeve that is open at its top and bottom ends. As shown in FIG. 4, the workpiece 20 is then rotated so that when laid flat the stitch or joint 24 is located approximately equidistant between the lateral edges.

Figure 6:
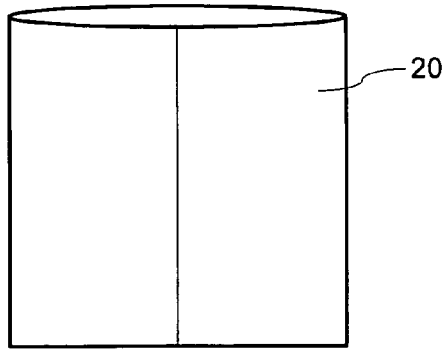
Figure 7:
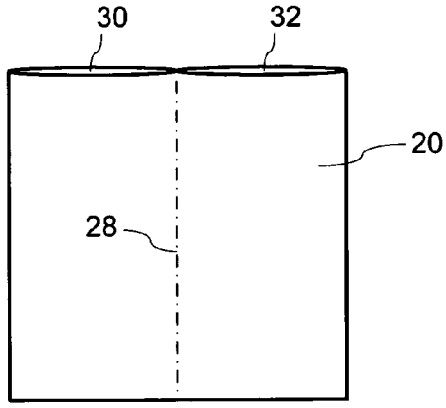
Figure 5:
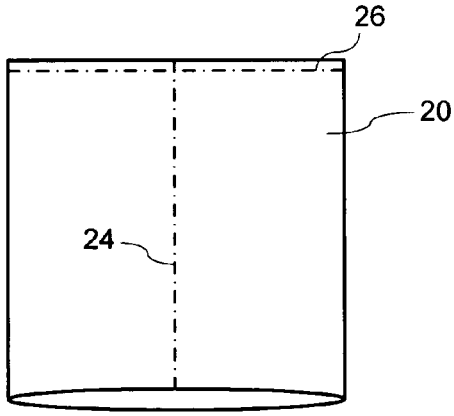
Figure 8:
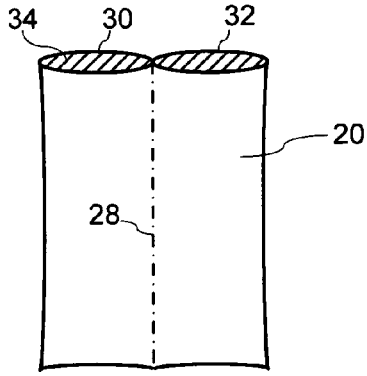

As shown in FIG. 5, the workpiece 20 is then stitched 26 or otherwise joined along its bottom end such that the workpiece 20 is closed along its bottom and lateral edges. As shown in FIG. 6, the workpiece 20 is then turned inside out such that the lateral edge stitch or joint 24 and bottom edge stitch or joint 26 are situated within the interior of the workpiece 20. As shown in FIG. 7, the workpiece 20 is then stitched or otherwise joined 28 from bottom to top to divide the workpiece into two separate and approximately equally sized sleeves 30, 32. Then, as shown in FIG. 8, the two sleeves 30, 32 are filled with a filler material 34, causing the sleeves 30, 32 to assume a tubular shape such as that illustrated in FIG. 1.

Figure 9:
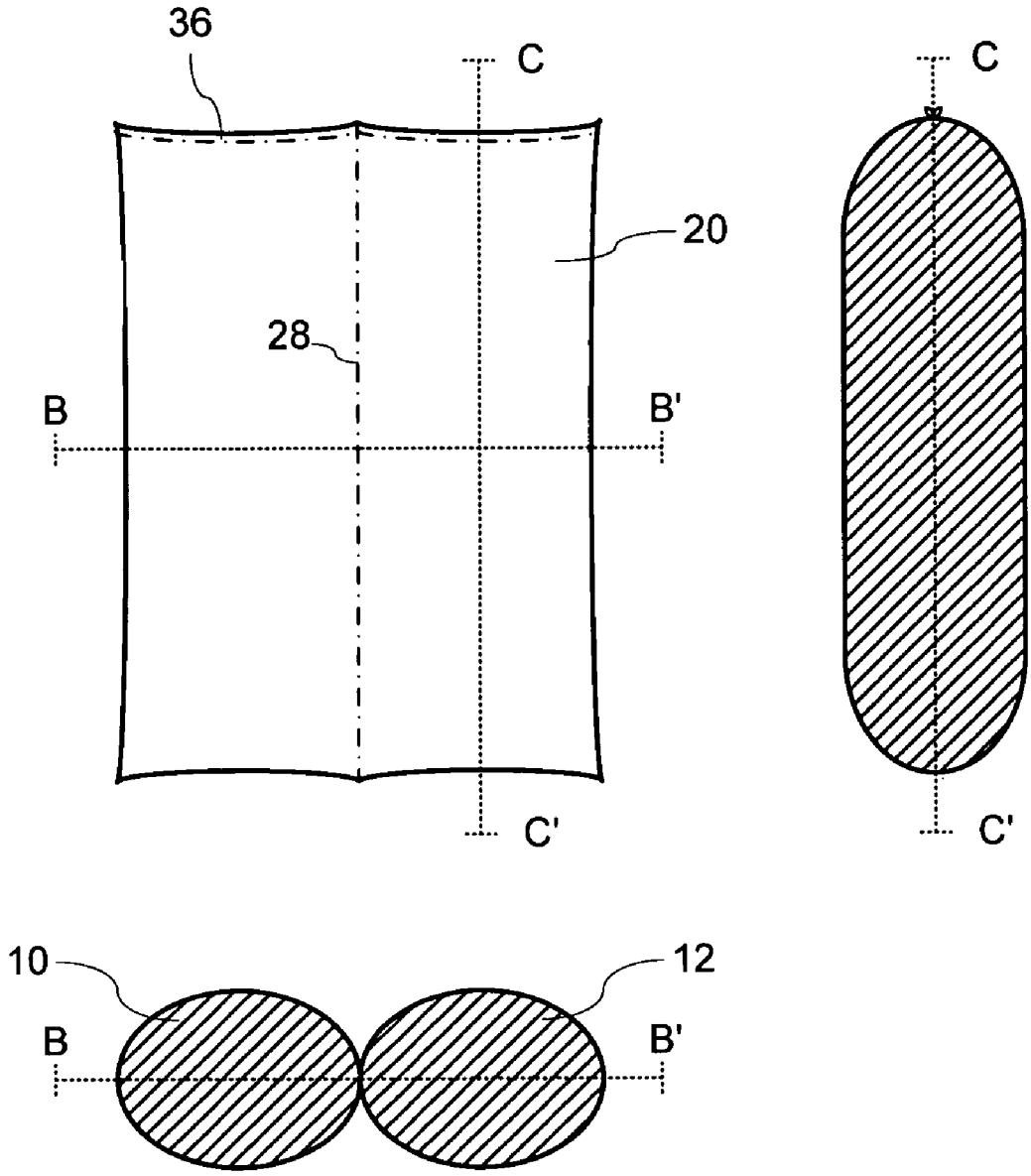

As shown in FIG. 9, after filling, and preferably after turning the fabric inward at the open ends of the sleeves, a final stitch 36 is made at the open ends of the sleeves 30, 32 to close the sleeves, yielding a completed pillow or cushion device. The plan view of the completed pillow or cushion device shown in FIG. 9 includes sectional views at lines B-B' and C-C'. Referring to the sectional view along line B-B', it will be appreciated that by rotating location of the stitch or joint 24 of FIG. 3 to the approximate center of the workpiece 20 before closing the bottom end of the workpiece 20 and forming sleeves 30, 32, the preferred manufacturing method avoids placing stitches or other joining structures at surfaces of the pillow device where the stitch or other joining structure would be likely to contact a user. This avoids creating pressure points that result from the bunched fabric or other material of increased density typically found at the stitches or other joining structures.

While the preferred manufacturing method forms a fabric structure with a permanent closure at both ends of the sleeves, alternative structures may be formed by alternative processes. For example, where a structure other than the sleeves formed by the outer covering of the pillow is used as the primary barrier for retaining filler material, it may be desired to provide sleeves having a permanent closure at only one end so that separate inserts containing filler material may be inserted into and removed from the outer covering, for example, to facilitate cleaning of the outer covering. Thus, where the inserts are, for example, bladders containing water, air, or a gel, an end of the sleeves may be left open, may be provided with simple flaps that tuck into the sleeves after insertion of the bladder, or may be fitted with a temporary closure such as Velcro, snaps, buttons, zippers or the like. Inserts containing other fillers materials such as dry solid fillers may also be used.

Further, while it is preferred to form the pillow of a stitched fabric, other manners of joining the fabric may be employed, such as gluing, heat sealing or welding. Further, the pillow or cushion device can be manufactured in alternative manners. For example, the tubular members can be molded from a moldable material such as rubber or another polymer so as to be capable of containing air, water or gel as a filler. Such a structure may be molded as a unitary structure comprised of both tubular members, and may be provided with valves or other structures to allow injection and removal of water or air.

In some instances it may be desired to provide a separate case to contain the pillow or cushion device. Such cases may be provided in a variety of forms such as a simple pocket for containing the pillow, or a pocket with a flap to be tucked into the case after the pillow is inserted. The case may be made of a fabric similar to that of the pillow. For use in medical situations, it may be desirable to provide a disposable case made of a material such as a paper/plastic laminate. Alternatively the case may be made of a material that is easily cleanable.

Figure 10:
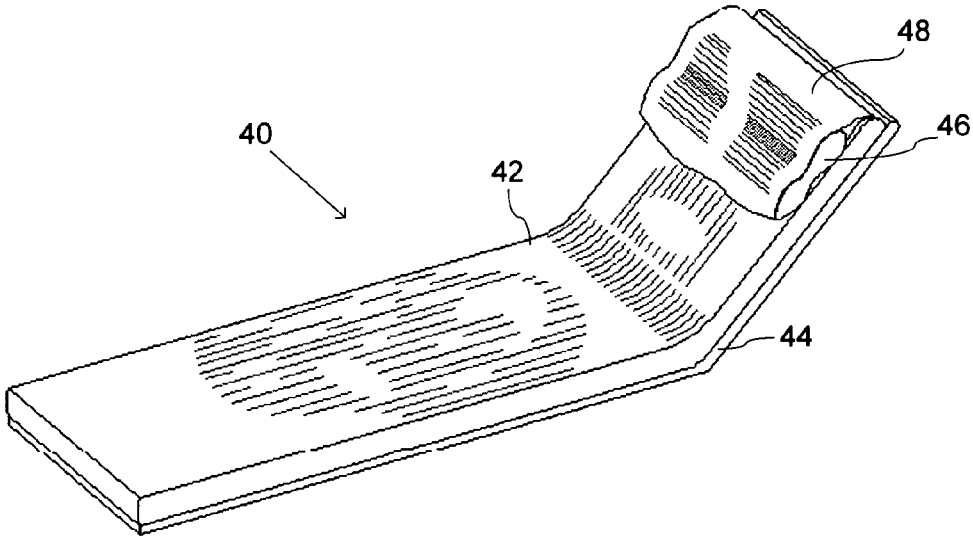
Figure 11:
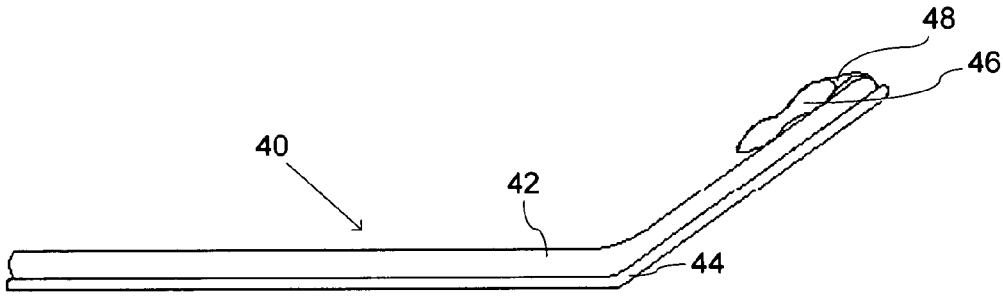

FIGS. 10-16 relate to a preferred embodiment for use with a gurney, hospital bed, or similar device. FIG. 10 shows a perspective view of a gurney 40 comprised of a mattress 42 and a frame 44. A cushion or pillow device 46 of the type illustrated in FIGS. 1 and 10 is provided at approximately a location where a patient's head will rest. In the preferred embodiment, the cushion or pillow device 46 is supported by an elongated pillow case 48 that contains the cushion or pillow device 46 and is secured to an end of the gurney 40 so that the cushion or pillow device 46 hangs at the desired location. FIG. 11 shows a side elevation of the same structure. From this angle it may be seen that the cushion or pillow device 46 may be located such that a valley portion of the cushion or pillow device is located so as to engage the rear portion of a patient's head to provide comfort and stability.

Figure 12:
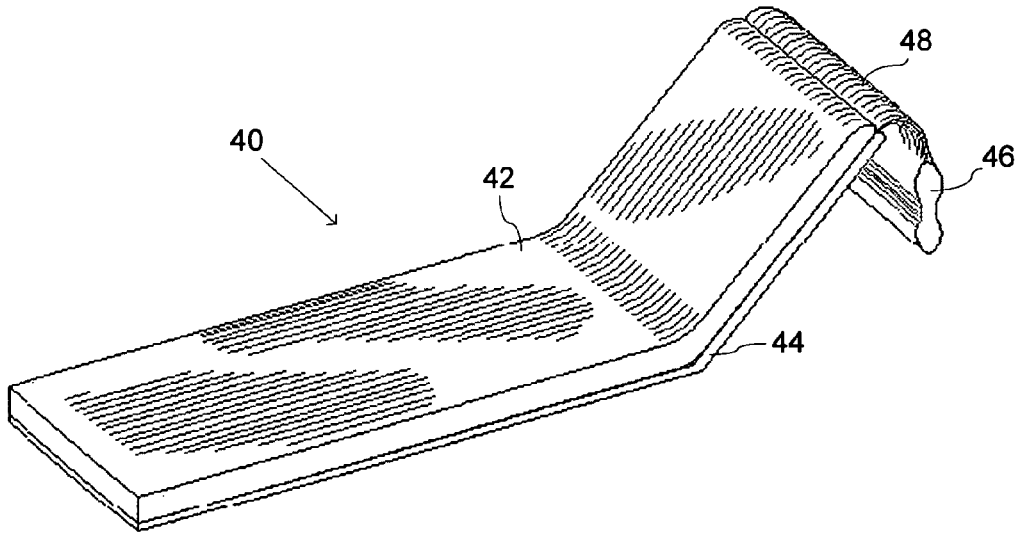

FIG. 12 shows a perspective view of the gurney of FIG. 10 with the cushion or pillow device 46 moved off of the gurney mattress 42 into a hanging position behind the gurney 40. This allows an attending person such as an EMT to move the cushion or pillow device 46 out of the way while keeping it secured to the gurney 40 and within reach. This is especially helpful in instances where a c-spine or backboard is used.

The case 48 that contains the cushion or pillow device 46 is may be a case used for a standard bed pillow, with the pillow or cushion device placed at the closed end of the case. Alternatively, the case is preferably made from a disposable material such as paper, plastic, or a paper/plastic laminate. The case 48 may be secured to the gurney 40 in a number of fashions. In the preferred embodiment, one end of the elongated case 48 is tucked between the gurney mattress 42 and gurney frame 44. The case 48 is preferably formed in a manner that enables it to be tucked deeply beneath the mattress 42 to provide ample securing force.

Figure 13:
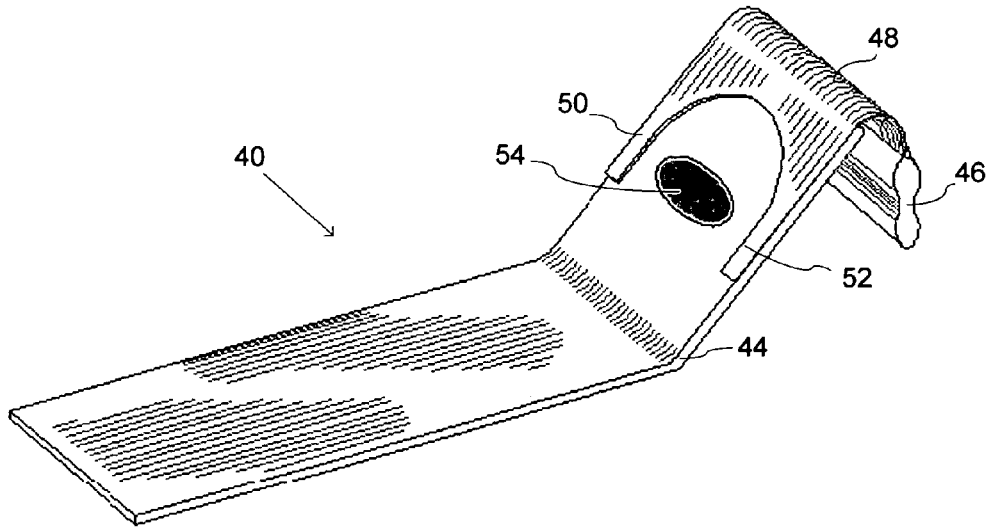
Figure 14:
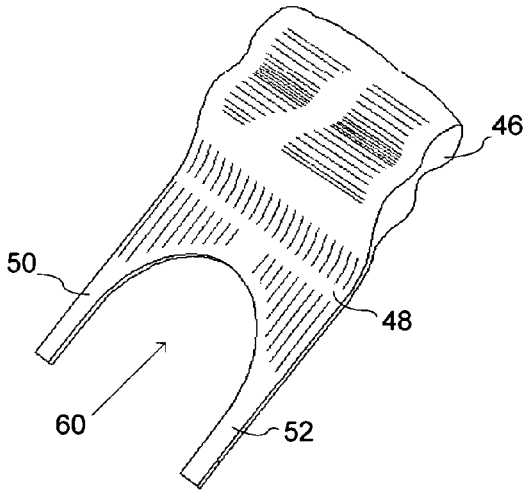
Figure 15:
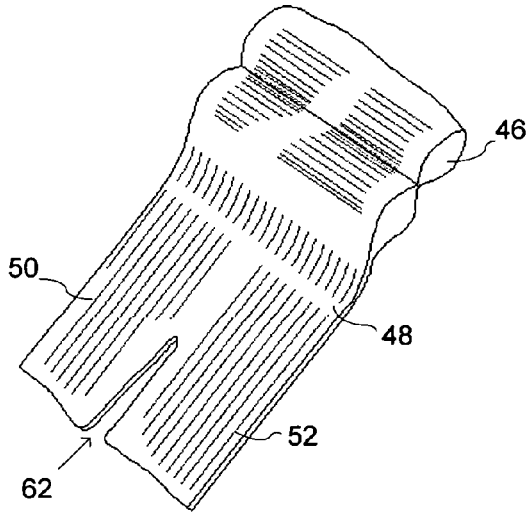

FIG. 13 shows the gurney 40 of FIG. 12 with the mattress removed to reveal a preferred structure of the case 48. The elongated portion of the case 48 preferably is divided into arms 50, 52 that straddle the hook and latch or other securing device 54 that normally secures the mattress 42 to the gurney frame 44. Embodiments of such a case are illustrated in FIGS. 14 and 15. In the embodiment of FIG. 14, the case 48 is formed to have a wide cutout 60 between the arms 50, 52. In the embodiment of FIG. 15, the case is provided with a simple slit 62 to divide the arms 50, 52. The slit 62 may be preformed. Alternatively, the case 48 may be provided with a perforation at the location of the slit 62 so that the slit 62 can be opened, if needed, by the person securing the case 48 to the gurney or bed.

Figure 16:
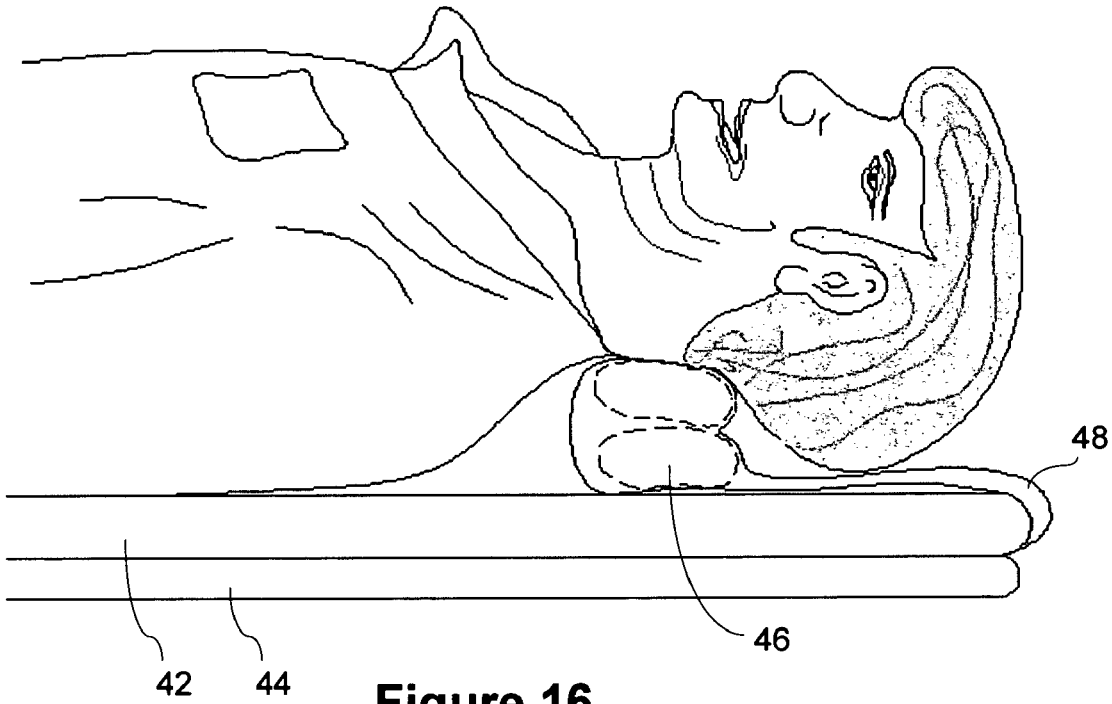
FIG. 16 shows the use of a cushion or pillow device to provide support beneath a patient's neck and to position the patient's head for intubation.

FIG. 16 shows the use of the cushion or pillow device 46 on a gurney 40 for positioning a patient's head. In this use, the pillow 46 is located beneath the patient's neck and is doubled over on itself to effectively double its thickness. This is advantageous when positioning the patient's neck for intubation or applying a BVM. When the procedure is complete, the cushion or pillow device 46 can be returned to its previous position beneath the patient's head, or can be moved out of the way to hang off the back of the gurney.

Figure 17:
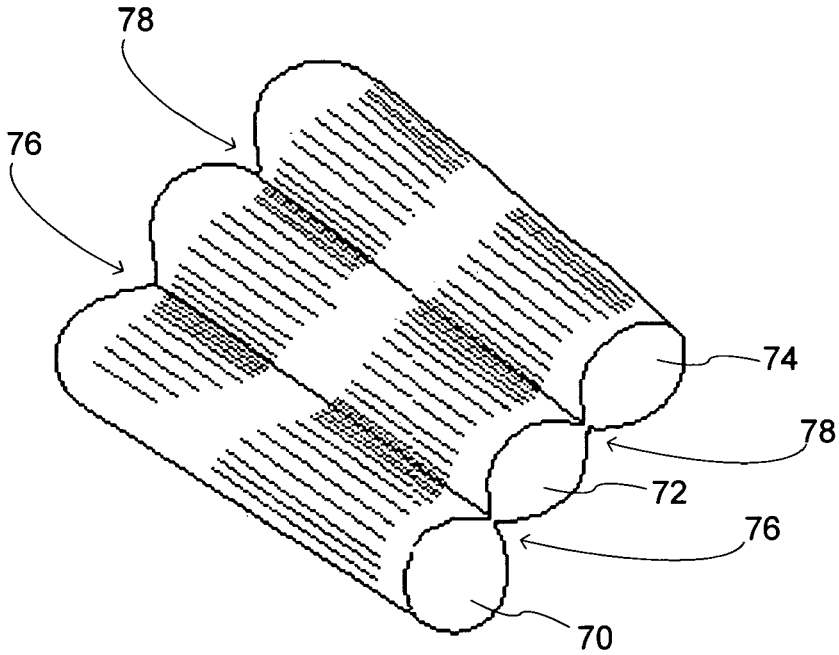
FIG. 17 shows another embodiment of a cushion or pillow device.

FIG. 17 shows another embodiment of a cushion or pillow device. The cushion or pillow device is comprised of three tubular members 70, 72, 74 that are joined at respective lateral edges to form two valley portions 76, 78 between them. The cushion or pillow device of FIG. 17 may be used to provide comfort, support or positioning in a manner similar to that shown for the cushion or pillow device of FIG. 1.

The embodiments illustrated and described in this specification are not exclusive of other features, embodiments and variations.

What is claimed is:

1. A cushion device consisting of first and second tubular members, each tubular member comprised of an outer cover and an inner portion comprising a pliable filler, the first and second tubular members being joined at respective lateral portions to define valleys between the tubular members, the first and second tubular members having outer surfaces that are free of seams along the lengths of the tubular members outside of the valleys.

2. The cushion device as claimed in claim 1, wherein the outer covers of the first and second tubular member are formed by a single sheet of material.

3. The cushion device claimed in claim 2, wherein the single sheet of material is joined by at least one seam.

4. The cushion device claimed in claim 2, wherein the at least one seam includes:

a first seam joining opposing ends of the single sheet of material, and a second seam joining opposing portions of the single sheet of material to define first and second sleeves.

5. The cushion device claimed in claim 4, wherein the first and second seams are located in the valleys.

6. The cushion device claimed in claim 1, wherein the first and second tubular members are joined by one or more seams located in the valleys.

7. The cushion device as claimed in claim 1, wherein the pliable filler is a synthetic fiber material.

8. The cushion device as claimed in claim 1, wherein the pliable filler is retained by the outer covers.

9. The cushion device as claimed in claim 1, wherein the outer covers are closed at their respective ends.

10. The cushion device as claimed in claim 1, wherein the tubular members are of a length and girth sufficient for supporting a human limb resting in a valley between the tubular members.

11. The cushion device as claimed in claim 1, wherein the tubular members are of approximately equal length and equal girth.

12. The cushion device claimed in claim 1, further comprising a case comprising a third sleeve containing the first and second tubular members, the case having an elongate portion for tucking beneath a mattress to retain the cushion device at a position with respect to the mattress.

13. The cushion device as claimed in claim 12, wherein the case is a pillow case for standard bed pillow.

14. The cushion device as claimed in claim 12, wherein the elongate portion of the case is comprised of first and second arms.

15. The cushion device as claimed in claim 14, wherein the first and second arms are separated by a cutaway.

16. The cushion device as claimed in claim 14, wherein the first and second arms are separated by a slit.

17. The cushion device as claimed in claim 12, wherein the elongate portion comprises a perforation to allow tearing of the elongate portion to form first and second arms in the elongate portion.

18. A cushion device consisting of first and second tubular members joined at respective lateral portions to define valleys between the tubular members, an outer surface of the cushion device being comprised of a sheet of material having opposing ends joined by a first seam and having opposing walls joined by a second seam to define first and second sleeves, the first seam and the second seam being located in the valleys of the cushion device.

19. The cushion device as claimed in claim 18, wherein the first and second sleeves contain a pliable filler.

20. The cushion device as claimed in claim 18, wherein the first and second sleeves are closed at both ends to retain a pliable filler within the sleeves.

* * * * *